United States Patent [19]

Britton et al.

[11] 4,175,490

[45] Nov. 27, 1979

[54] PROCESS FOR PRODUCING AN UNDERGROUND ZONE OF FRAGMENTED AND PERVIOUS MATERIAL

[75] Inventors: Keith C. Britton, San Leandro; Mitchell A. Lekas, Concord, both of Calif.

[73] Assignee: Geokinetics Inc., Concord, Calif.

[21] Appl. No.: 848,091

[22] Filed: Nov. 3, 1977

[51] Int. Cl.[2] ..... F42D 3/04

[52] U.S. Cl. ..... 102/23; 166/259; 166/299; 299/2; 299/13

[58] Field of Search ..... 166/259, 299; 299/2, 299/13; 102/22, 23

[56] References Cited

U.S. PATENT DOCUMENTS

| | | | |
|---|---|---|---|
| 3,917,347 | 11/1975 | Janssen | 102/23 |
| 3,973,497 | 8/1976 | Coursen | 102/23 |
| 4,015,664 | 4/1977 | Acheson et al. | 102/23 |
| 4,037,657 | 7/1977 | Lekas | 166/299 |
| 4,118,071 | 10/1978 | Hutchins | 299/13 |

*Primary Examiner*—Verlin R. Pendegrass
*Attorney, Agent, or Firm*—Warren, Chickering & Grunewald

[57] ABSTRACT

The subterranean fragmented and pervious zone is formed beneath an overburden which, as a first step of the process, is lifted as a substantially monolithic land mass to produce a void space and a free space proximate the rock to be fragmented, the raised overburden thus providing a substantially impervious lid or closure for the fragmented zone as formed by the present invention. Explosive charges are then placed proximate to and for blasting against the free face formed on raising the overburden. The charges are exploded to fragment the rock to distribute the space, thus producing fractured, pervious rubble-ized rock in a defined and enclosed zone. Different techniques are disclosed for the critical raising of the overburden and subsequent fragmenting of the rock.

55 Claims, 26 Drawing Figures

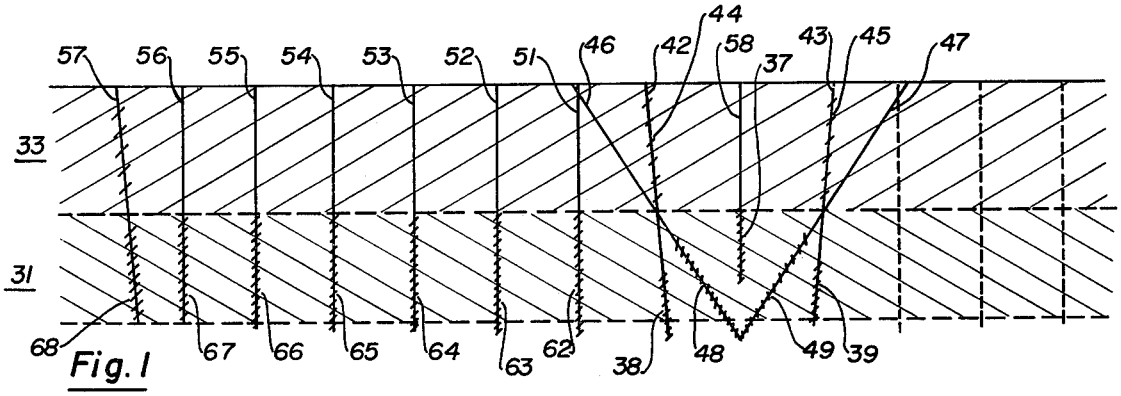
Fig. 1
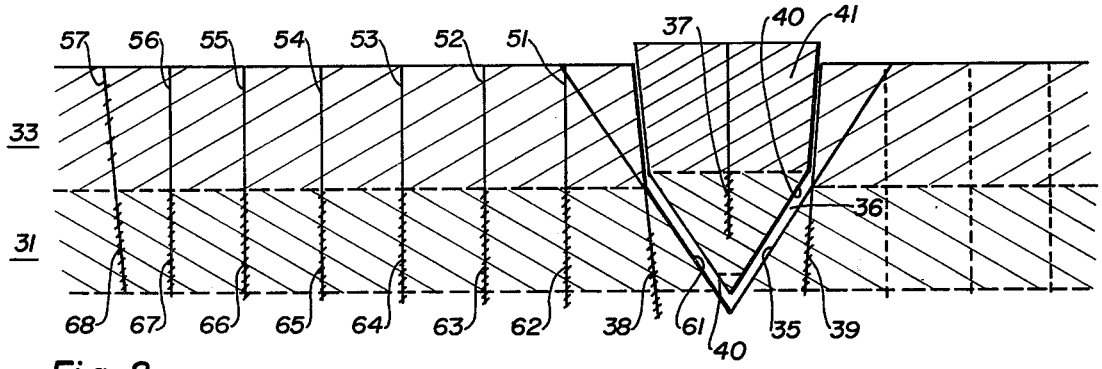
Fig. 2
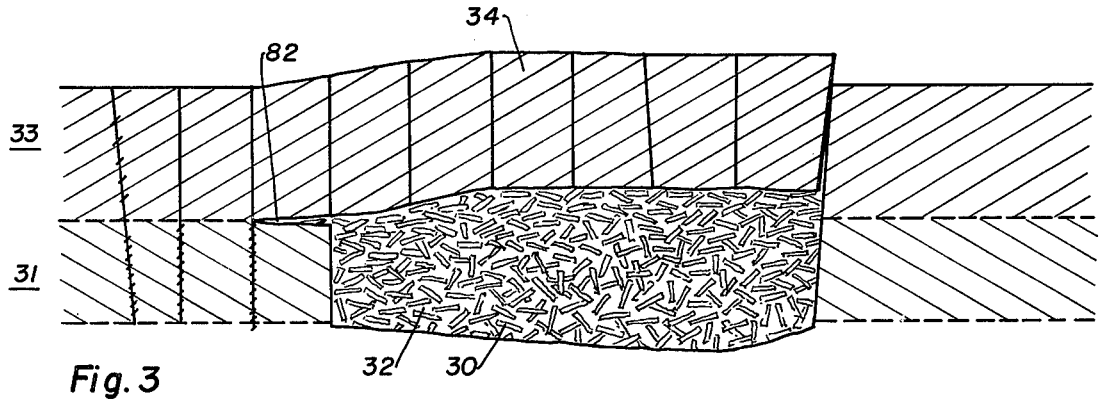
Fig. 3
Fig. 4
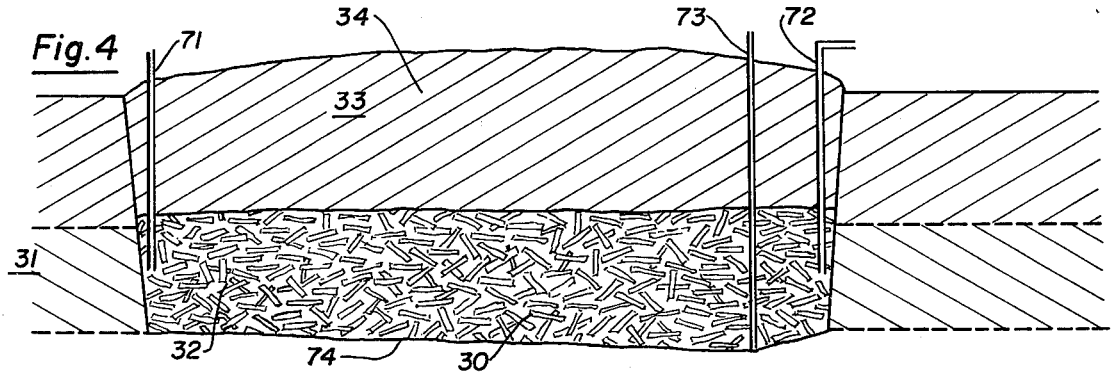

PROCESS FOR PRODUCING AN UNDERGROUND ZONE OF FRAGMENTED AND PERVIOUS MATERIAL

BACKGROUND OF THE INVENTION

1. Field of Invention

The invention relates to processes for producing an underground zone 32 of fragmented and pervious material which may be used as a storage area, as a passage or aquifier, for treatment of materials, for ore body leaching or for recovery of carbonaceous materials from subterranean deposits. An example of the latter use is the extraction of oil and hydrocarbon gases from oil shale by in situ retorting, see Lekas U.S. Pat. No. 4,037,657.

2. Description of Prior Art

In one form of the invention disclosed in the above-referenced patent, a plurality of blast holes are drilled through the overburden and into the ore body, explosive charges placed in the holes and exploded to fragment the ore body. As a by-product of the fragmenting of the ore body to produce rubble, the surface of the ground above the rubble so formed expands upwardly with attendant cracking of the overburden. Accordingly, to produce an enclosed in situ retort, the cracks need be sealed, as by pumping a mud slurry or the like into the cracks or, alternatively, the top surface may be sealed by means of a layer of soil, plastic sheets or the like.

It has been found that, even where light charges are used to fragment the oil shale, near-surface retorts are incapable of enclosing gas under appreciable pressure—more than a few pounds per square inch. Even at low pressures of this magnitude, leakage is a serious problem if the overburden is significantly fractured, as happens if the surface is greatly domed over the retort zone. Sealing can be expensive and ecologically disadvantageous in that surface vegetation is destroyed and membranes remain after the retorting process is completed.

Another problem encountered in the prior art is the inefficient use of explosives to fragment the oil shale in the absence of a free face against which blasting can take place. If the explosives are to fragment the material by passage of waves which do not have a free face to operate against, the amount of explosives needed is greatly increased and the stress level likewise increased. Such stresses must necessarily impact the overburden and, moreover, the upper surface of the burden presents an acoustic mismatch, i.e., a free face. It is thus impracticable to avoid unwanted damage to the overburden.

SUMMARY OF THE INVENTION

An object of the present invention is to provide techniques for lifting a defined area of overburden as a substantially monolithic land mass, thus producing (a) a void space and (b) a free face proximate rock underlying the overburden and (c) a substantially impervious closure for the space and the rubble-ized zone to be formed. Thereafter, explosive charges are exploded in the rock proximate to and for blasting against the free face, item (b) supra, and for fragmenting the rock to distribute the space, thus producing fractured, pervious, rubble-ized rock in a defined enclosed zone. The explosive fragmenting of the rock produces gaseous pressure augmenting the first-step raising of the overburden and enlargement of the space thus created.

Further, the process of the invention is applicable to numerous situations. For some requirements, only a subset of the features of this invention would be required. Thus, the in situ leaching of a mineral deposit would not require that extreme care be exercised to maintain the integrity of the overburden block as an impervious lid, since a leaching process does not require containment of pressurized gas. This invention is, nevertheless, of significant value for such a situation in that expense and energy are not wasted fragmenting overburden, a method is provided for the reliable and economical production of a controlled degree of fragmentation and permeability within a well defined zone, and the retention of a substantially monolithic overburden allows either preservation of the upper portions of original blast holes or at least easy re-entry drilling, as well as keeping intact and undamaged the ground surface and vegetation thereon. Similarly, features of this process are of value tc meet other and diverse requirements. In that the most difficult case is that of an in situ retort in oil shale, the embodiments described in the following specification are of that nature. It should, however, be clearly understood that this process is general in nature and not limited to any particular mineral, recovery method or use to which the production of a defined zone of pervious fragmented rock may be put.

Another object of the present invention is to provide effective and efficient techniques for producing the above-described in situ retort in various extant and valuable geological formations.

A further object of the present invention is to provide a process of the character described with minimum ecological disturbance or impact.

The invention possesses other objects and features of advantage, some of which will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 1 is a vertical sectional view of an arrangement of blast holes and charges designed for carrying out one of the processes of the present invention.

FIG. 2 is a vertical sectional view similar to FIG. 1, but depicting an intermediate step in the process.

FIG. 3 is a vertical sectional view similar to FIGS. 1 and 2, but depicting a further development of the process.

FIG. 4 is a vertical sectional view similar to FIGS. 1–3, depicting a completed in situ retort.

DETAILED DESCRIPTION OF THE INVENTION

Figure 13:
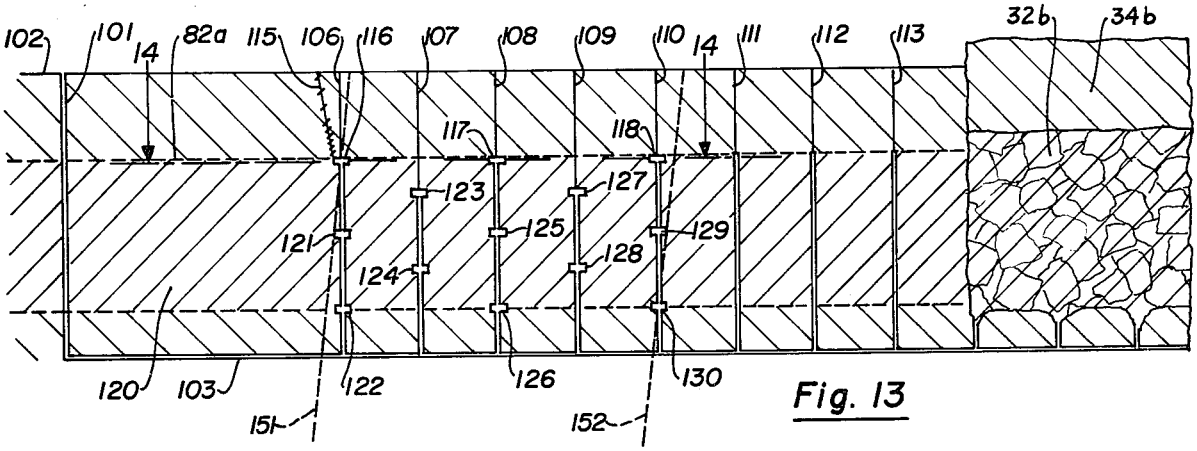
FIG. 13 is a vertical sectional view showing an arrangement of bore holes and charges designed for carrying out a third form of the invention.

The process of the present invention is designed for producing an underground zone 32 of fragmented and pervious material 30, the zone thus formed being usable as a storage area, a passage or aquifier, for treatment of materials, for ore body leaching, for recovery of carbonaceous materials from subterranean deposits, etc. Specifically, in the embodiments here depicted, the process is designed for converting a subterranean ore deposit 31 into an enclosed in situ ore-rubble-filled retort 32 overlain by an overburden 33 and which comprises the steps of lifting a defined area 34 of overburden as a substantially monolithic land mass to produce a void space 36 and free faces 35, 40 and 61 proximate the deposit; placing one or more explosive charges 37, 38 and 39 in the deposit proximate to and for blasting against faces 35, 40 and 61; and exploding the charges for fragmenting the deposit to distribute the space, thus producing fractured, pervious, rubble-ized deposit 30 in a defined enclosed retort, it being noted that a lifting of the overburden 33 as a substantially monolithic land mass provides a substantially impervious lid or closure for the retort thus formed. Blasting is markedly less efficient in the absence of a free face to which the material may be broken. As above noted, such a free face 35, 40 and 61 is provided in an initial uplifting of the overburden which is effected by placing under the overburden to be lifted, and exploding, an explosive charge, thereby producing a gaseous pressure to effect a first-stage raising of the overburden to provide the aforementioned void space and free face. The use of explosive charges for thereafter fragmenting the deposit will produce additional gaseous pressure and effect an additional raising of the overburden and enlargement of the retort space. When the material in the retort has been fragmented, a great deal of high pressure gas is entrained in a sponge of debris and the expansion of this sponge causes a steady lifting of the overburden. This takes place over some tenths of a second to some seconds. A slow, shoving force on the overburden is much preferred over a more violent action to ensure the lifting of the overburden substantially intact as a monolithic lid structure.

It has been found that, by lifting the surface in an essentially monolithic manner, leakage is principally confined to the edges of the retort where the leakage will be small enough to be tolerable in a low pressure retorting system or where the leakage is concentrated into an area sufficiently small that sealing by means of mud injection or similar means is economically feasible.

Oil shale deposits vary both as to size, subterranean depth and kerogen content. The section of usable grade oil shale may vary in thickness from a few feet to some hundreds and even thousands of feet. Similarly, the depth of overburden may vary over a wide range. Preferably, the processes of the present invention are used where the thickness of the overburden does not exceed about 3 times the thickness of the underlying high grade oil shale. Within this general ratio, there appears to be no depth limitation. The overburden may frequently be oil shale which is uneconomic to treat by the present process. The cut-off point between overburden and high grade deposit is normally determined economically, although the separation may be affected by geological conditions, such as the presence of a mud seam. In some sites, the upper surface of the high grade oil shale is a fairly clean horizon to essentially barren material above it. For example, the shale in the overburden may assay at less than 2 gal. per ton with the oil content rising abruptly to about 60 gal. per ton. Even high grade oil shale formations are highly laminar, not untypically varying over a few inches between lows of about 10 gal. per ton to highs of around 60 gal. per ton.

High grade oil shale, in contrast to common rocks, will withstand significant strain without breaking. Blasting it has been compared to blasting hard rubber. The material is also extraordinary in its laminar structure. Thus, since the properties vary dramatically with changing kerogen content and the changes may be abrupt or gradual, depending upon the geological history of the adjacent layers of the formation, the material is unlike any material which has been subjected to extensive blasting research. Its laminar structure also results in marked anisotropy, tensile strength parallel to laminations being typically 3 times greater than that normal to lamination.

Understanding of the often unexpected phenomena exhibited by the material is vital to successful blasting operations and to understanding of the novel blasting practices which form the basis of the processes described in this application. Because of the marked anisotropy of the material, it is comparatively easy to propagate a fracture in the plane of lamination, fairly easy to fracture normal to such plane, but often very difficult to fracture it at an intermediate angle. Where this must be done, special methods are necessary or heavy explosive loads are necessary.

The compressibility has other effects. It has been observed by Wright, Burgh and Brown that blast holes in high grade oil shale require heavier charges for comparable breakage than corresponding blast holes in leaner oil shale; however, no explanation for this was given. The reasons for this have been studied and, with understanding of the processes involved, it has proved possible to materially improve the effectiveness of the blasting process. When an explosive charge is fired, the material in the immediate vicinity experiences an intense pressure wave. If this wave is sufficiently intense to cause plastic deformation of the surrounding material, the material will be displaced outwardly with simultaneous crushing. This process will continue until the intensity of the pressure has decayed to the point at which the material can sustain the stress by elastic deformation. Two processes will contribute to the decay of pressure: the expansion of the wave with resulting distribution of the energy over a larger area and the loss of energy involved in the plastic deformation, crushing, of the material. Any energy used in such crushing is clearly wasted from the point of view of blasting which is intended to produce fragmented material rather than intensely deformed, locally crushed material. The energy loss from the source is, however, more serious than merely a local waste. The blasting process relies upon the energy radiated in the pressure wave. This energy is radiated to the nearest free face and then reflected as a tensile wave. This wave returns, interacts with cracks produced in the immediate vicinity of the charge, allowing such cracks to propagate until they reach the free face. Only at that point will the material to be torn loose by the charge be free to move. The time between this movement and the original firing of the charge is known as the release time. It is obvious, therefore, that it is important to maximize the energy available for elastic transmission and, therefore, important to minimize the amount of crushing occurring in the immediate vicinity of the charge. In the case of high grade oil shale, where this material is extraordinarily compressible, methods novel to the blasting art are necessary to avoid excessive energy losses. Accordingly, it is a feature of the present process to locate the explosive charges preferentially in harder strata of the deposit.

In the form of the invention illustrated in FIGS. 1–5, an initial step comprises the raising of a block 41 of overburden to provide the initial void space 36 and free faces 35, 40 and 61. Block 41 is preferably provided with a sheared periphery to facilitate its lifting from the balance of the overburden, that is, there are first defined planes of discontinuity peripherally around the block. These planes of discontinuity may be partially or completely supplied by orienting the block with respect to planes of natural weakness in the geological formation. Such planes are quite visible to a trained eye, particularly after the first two or three retorts have been formed. Trenching back into the edges of the retort will disclose how the ground failed. Many joints show evidence of weathering, some are in fact soil-filled, and these are particularly evident when the ground has been stressed. Further, trenching will expose typical facet alignment and often movement at major and minor axes of local jointing. A typical jointing pattern is 105° and 75°, as depicted by major and minor axes 59 and 60 in FIG. 5, it being noted that the orientation of the long axis of the retort is chosen to conform with the major jointing axis 59.

Where such planes of discontinuity peripherally about the block are not present by reason of local jointing, they may be produced by explosive fracturing. This may be done by the well known technique of pre-splitting. This technique involves the drilling of a series of holes 42 and 43 located substantially in planes, the loading of the holes with light charges 44 and 45 and their simultaneous firing. This produces a fracture connecting all of the holes and establishing a continuous plane of breakage within the overburden.

As a feature of the invention, blast holes 42 and 43 are preferably drilled through the overburden at an angle sloping inwardly, downwardly to provide withdrawn wedge relief of friction as block 41 is raised. This same effect can be obtained where planes of natural weakness can be detected, sloping downwardly and inwardly with respect to the block, then orienting the block to be raised in conformity thereto, see joint 152 in FIG. 13. Initial lifting of the block is here obtained by drilling of a series of blast holes 46 and 47 arrayed substantially along planes having a substantial horizontal component, placing explosive charges 48 and 49 in these holes and exploding the charges to provide a gas-filled fracture forming void space 36 underlying block 41. Preferably, blast holes 46 and 47 are arranged along opposed downwardly converging planes so as to produce a wedge-shaped block of raised overburden.

To aid in the initial lifting of the block and also to initiate fragmenting of the deposit charges 38 and 39 are decked in selected bore holes 42 and 43, which are extended downwardly so as to place the charges 38 and 39 within deposit 31 and adjacent to charges 48 and 49; and charges 37 are emplaced in the deposit generally between charges 48 and 49, via blast holes 58. Charges 37, 38 and 39 are fired, as hereinafter more fully discussed, to provide both an initial fragmenting of the deposit and an assist in the raising of the block.

The void space, volume of rubble and retort zone may be progressively increased, as seen in FIGS. 3 and 4, by loading and exploding a series of blast holes arranged in the deposit 31 in horizontally spaced relation to, and retreating from, free face 61 at one side of block 41. Charges 62, 63, 64, 65, 66, 67 and 68 in holes 51–57 are sequentially exploded in an order moving progressively away from free face 61 to successively horizontally enlarge the void space and the quantity of fragmented material and to progressively enlarge the area of the raised overburden 34, see FIG. 3. The process is continued until a desired size retort 32 is formed, as seen in FIG. 4.

Manifestly, for the overburden to be raised substantially intact it must not be caused to dome or to otherwise flex to an excessive degree. This is prevented by the use of a combination of techniques, mostly related to the edge conditions of the block. Clearly, the ideal situation is one where the block is lifted flat and level, being cleanly sheared from the parent rock about its periphery. This is only possible where inclined pre-splitting or presence of an inclined joint or fault allows withdrawn wedge relief of friction.

Figure 24:
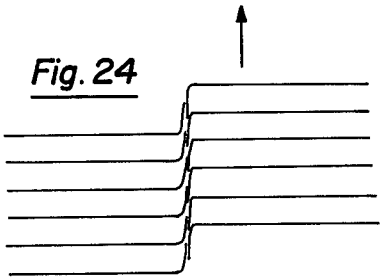
FIGS. 24, 25 and 26 are diagrammatic cross-sectional views of typical edge formations of overburden raised in accordance with the processes of the present invention.
Figure 25:
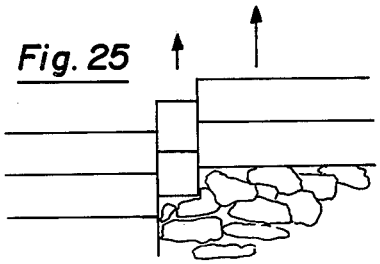

When no wedge angle exists, pre-fracturing by pre-splitting will improve the wedge condition, but relative movement of the surfaces will be resisted by friction, producing a situation analagous to the drag folding, well known to geologists and generally illustrated in FIG. 24. If the ground is suitable and care has been taken in the orientation of the retort, adjacent weaknesses may be effectively used to reduce this friction since, if the movement is spread over two or more surfaces, as illustrated in FIG. 25, the velocities involved will be reduced, reducing total friction.

Figure 26:
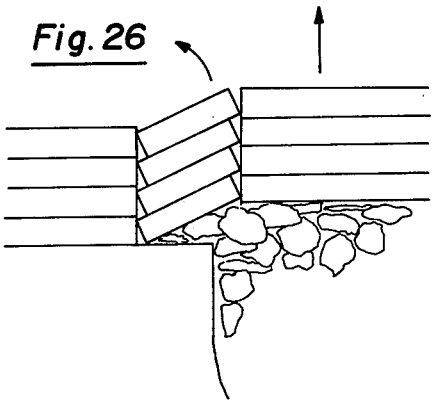

Much greater improvement may be obtained in the relief of friction if the material is made to fail in the open "double hinge" manner, shown in FIG. 26. For this type of failure to occur, there must be two vertical weaknesses and slippage must be possible on the planes between the laminations in the hinge area. This can be conveniently arranged by the drilling of one or more lines of holes to define either or both of the weaknesses and the firing in such holes of charges heavy enough to shatter the material between the same. The laminate nature of shale ensures the adequately platy nature of the shattered zone. This may, of course, utilize an existing natural weakness and may be applied to the initial block as well as any subsequently lifted block.

The edge preparation techniques discussed above are illustrated in FIGS. 13 and 14. Because of the unfavorable inclination of joint 151, a line of blast holes 115 has been positioned such that the detonation of a comparatively heavy explosive load in the lower portions of the blast holes will promote hinge failure between the plane of the holes and the joint plane, and simultaneous detonation of a lighter load in the upper portion of the blast holes will cause pre-splitting to detach the material above the hinge failure zone with resultant withdrawn wedge friction relief.

Further control of the lifting of an undamaged block is attainable by preferential concentration of explosive energy under the periphery of the block and by modification to blast hole timing and patterns to similaly locally improve fragmentation and concentrate the rubble.

Thus, there normally exists a considerable degree of flexibility in the options available and trade-offs for any particular site. Fundamentally, the greater the area of the retort relative to the depth of the overburden, the simpler the lifting problem and the less the necessary attention to improving the edge conditions. This is because the obtainable lift increases as the square of the horizontal scale factor, whilst the edge resistance increases only directly. The scale advantage also applies to the edge leakage problem. However, while there is no theoretical reason why several square miles of overburden should not be raised in a single shot, the resulting retort would obviously be difficult to control, and the initial capital investment unnecessarily high.

A further complication is the ratio of overburden to retortable oil shale. Since the lift is obtained by increasing the volume of the retortable oil shale, if the thickness of the layer concerned is insignificant compared to the thickness of the overburden, it will be difficult to raise the latter without attacking an unreasonably large area. If the overburden thickness is trivial compared to the thickness of a high grade deposit, the overburden will be raised high enough to render it discontinuous with the surrounding parent material, necessitating special edge sealing. Edge preparation involving extensive pre-splitting, such as is shown by 42, 43 and 57 on FIG. 1, may be too expensive for a 20' thickness of overburden over a 10' thickness of high grade oil shale, but edge preparation holes 115, FIGS. 13 and 14, would be but a trivial added expense.

Clearly, economic and practical considerations are too varied for this application to provide exact solutions, but as a guide to practical limits, it has proved practicable to produce an efficient retort using a combination of orientation and pre-splitting similar to that illustrated in FIG. 1, where the overburden depth exceeded the oil shale depth by a factor of 3, the width equalled the depth of the overburden and the length was twice the depth. Any improvement in these factors will reduce the difficulties experienced and improve the economics involved.

When the retort has been formed, as seen in FIG. 4, an air tube 71 is inserted into one end of the retort for injecting air from the surface into the rubble, and a flu or discharge tube 72 is mounted at the opposite end of the retort for extracting air and products of combustion which may be a useful hydrocarbon gas fuel. The rubble may be retorted either by igniting the rubble and moving a combustion front through it or by injecting gases or liquids at elevated temperatures which can extract the oil from the shale. Oil liberated from the shale may be pumped from a tube 73, here located at one end of the retort. Preferably, the blast holes forming the bottom of the retort will be drilled at different depths to provide a generally sloping bottom 74 for the retort, causing the flow of liberated oil to the bottom intake end of pipe 73. As will be understood, the hot gas moving ahead of the burn front raises the temperature of the oil shale to retorting temperature, driving off the oil, and leaving behind a carbonaceous residue which provides fuel for the advancing fire front. After a retort has been burned, it may act as a free face for further blasting, and the process similarly continued until the entire ore body has been processed.

It is desired that the overburden remain as intact as can be managed. The intense stresses produced by exploding or detonating explosives tend to be intensified in the direction of propagation of the wave of detonation or explosion. Accordingly, and as a feature of the present invention, initiation of the exploding of charges is effected from the top of each charge, thereby effecting propagation of the explosion in a downward direction so that the radiated waves of highest intensity will pass comparatively harmlessly out of the bottom of the retort zone or across the area intended to be fragmented, thus preventing such waves from sweeping to the surface and disrupting the overburden.

As another feature of the present invention, the charges used for lifting the overburden may be what are commonly referred to as "low explosives." As normally defined and as used herein, a "high explosive" is an explosive exhibiting detonation, that is to say, reaction involving a shock wave. A "low explosive," in contrast, is a deflagrating explosive, one not exhibiting a shock wave. A typical low explosive is black powder; a typical high explosive is TNT or nitroglycerine. The use of a low explosive operating at the plane of separation between the high grade ore to be recovered and the overburden to be lifted provides a pressure rise which is substantially less and is achieved in a substantially more gradual fashion than would be obtained with a high explosive. The specific and novel use of a low explosive for the particular operation described reduces the intensity of stress experienced by the overburden in terms of peak stress and also affects the duration of the loading time, giving again less severe stresses, causing eventually less damage and less energy loss in unnecessarily deforming the overburden.

With reference to FIG. 1, it is desirable to fire charges 48 and 49 in the wedge, which produce the lifting action, and charges 44 and 45 for effecting the pre-splits at substantially, preferably precisely, the same time. Block 41, as seen in FIG. 2, will be released and start to rise after a short delay, i.e., the release time of the block. Where the cut block is in overburden from about 15'–30' in thickness, the release time will be about 0.024 to 0.032 seconds. If the scale of retort is substantially increased, the release time will increase accordingly. The critical parameter is the burden on the lifting charge and this is effectively the depth of the overburden. Importantly, it has been found that charges 44, 45, 48 and 49 should be fired within a period of less than about ⅓ of the release time in order to obtain satisfactory raising of the block. Actually, a shorter time period is better and, desirably, all of the lifting charges are fired within about 10% of the total release time. The improvement in performance with increasing precision of the timing is to reduce differential stresses on the block, preventing fracture, and particularly to avoid degradation of the velocity obtained for the initial lift.

Figures 15, 16:
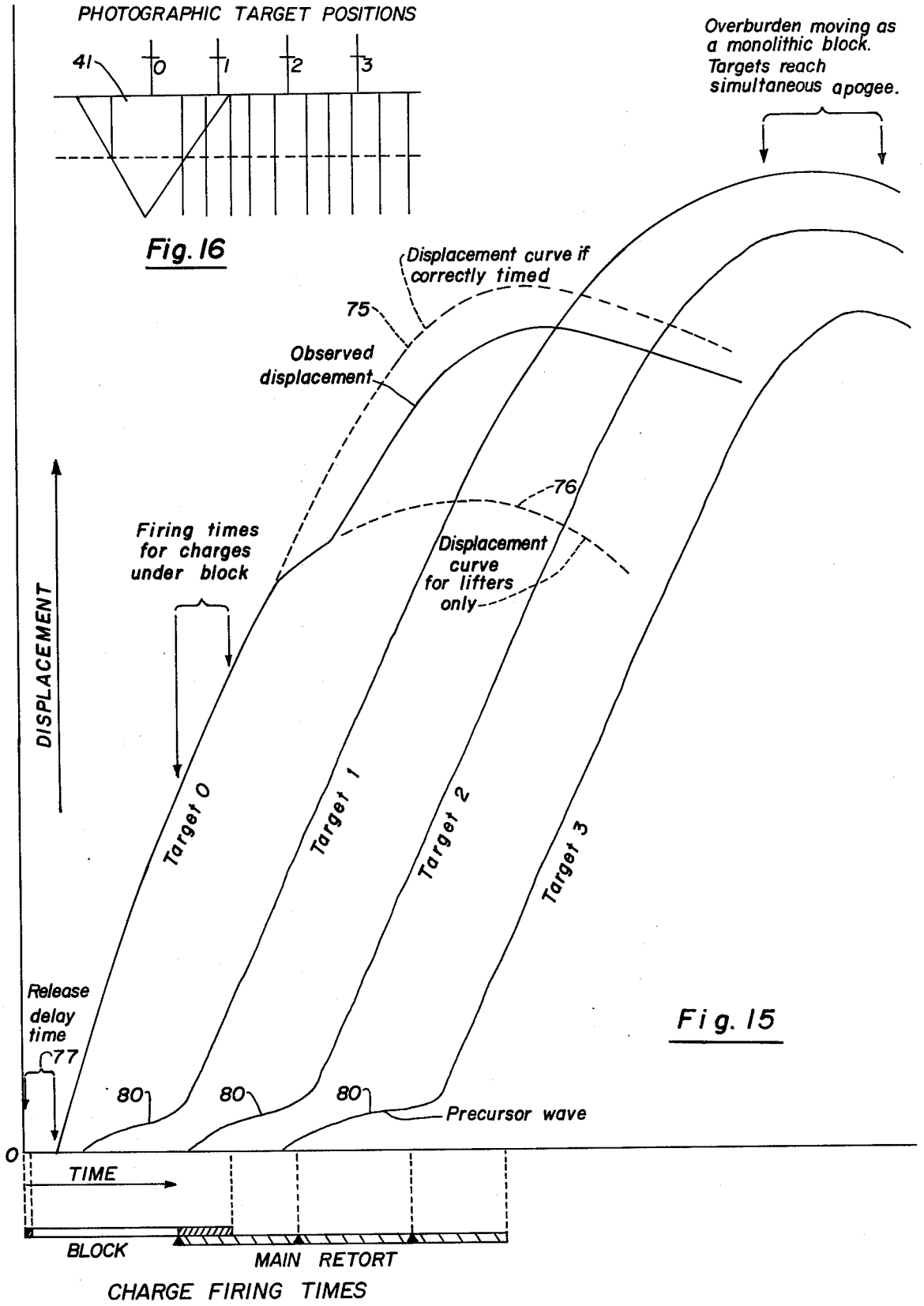
FIG. 15 is a chart showing the relationship between displacement of the overburden in the timing of firing of the successive charges in the practice of the present invention.
FIG. 16 is a diagrammatic vertical sectional view illustrating the position of photographic targets used in measuring ground displacement.

To effect the fragmenting step, charges 37, 38 and 39 within and adjacent to the wedge block are fired with a slightly delay following the firing of charges 48 and 49. These charges 37–39 not only effect fragmenting of the deposit, but also, as above noted, significantly augment the raising of the block. To do this most expeditiously, charges 37–39 are exploded with a slight delay following the firing of charges 48 and 49 Importantly, the time delay corresponds to the time required for the block to reach about ½ to ¾ of the unaided rise height of the block. The unaided rise height of the block is illustrated at 76 on the curve marked "target 0" in FIG. 15. With reference to FIG. 15, it will be noted that there is a release delay time 77 indicated for the block following the firing of the lifting charges starting at time 0. Also illustrated just below the base line of the chart, FIG. 15, is a showing of the charge firing times related to the movement of the several photographic targets, positioned as shown in FIG. 16. Lifting of the block 41 is depicted by curve marked "target 0," which corresponds to displacement of a discernible target 0, i.e., a photographic target mounted directly over the cut block. Assuming no further firing other than the lifting and presplitting charges, 44, 45, 48 and 49, the block would rise as depicted by the dash portion of curve "target 0" at 76. However, with the specified delayed firing of charges 37–39 the actual lifting of the block is augmented. In the test shot depicted, the delay was slightly too long to realize the full potential of the augmented rise, the actual observed displacement being shown in full lines on the drawing. With an ideal delay, a displacement as depicted in dash lines 75 would be obtained.

As the fragmentation process proceeds in the process, as depicted in FIGS. 1–3 and as more specifically shown in FIG. 3, a cleavage plane 82 is developed between the retortable shale and the bottom of the overburden being lifted, thus progressively providing an additional free face. The propagation of the separation is identified on FIG. 15 as the precursor wave 80.

The timing of sequentially firing fragmentation charges 62–68 significantly affects the degree of fragmentation, total lift, differential lift and subsequent permeability. When a single bore hole charge emplaced adjacent to a free face, as in a quarry bench shot, is fired, the breakage basically forms a triangular prism of removed material. This material is principally projected directly forward from the bore hole. If a subsequent charge is fired adjacent to the resulting dislocation in the smooth quarry wall, a parallelogram section prism is removed, the vector of movement of the material being partly away from the wall and partly in the direction of the previous hole. This is reasonably depicted by a vector connecting the bore hole and the center of gravity of the removed material. Where a multiple-row shot is involved, the material from the first firing holes must be removed before the subsequent firing holes fire for such holes to have a free face to break to. This is well known, but the timing of the firing necessary in normal blasting and the sequencing which controls the direction of movement of the resulting rubble is normally quite uncritical. Even simultaneous firing causes no more than poor breakage for most blasting. In contrast, for the unusual blasting processes of this application, it is essential that strict attention be paid to sequence and timing, as this involves important consequences and matter new to the art of blasting.

If a bore hole charge is fired in the absence of a free face, it will tend to produce a few major cracks rather than the many minor cracks produced by comparable charge which breaks properly to a free face. This will greatly affect the history of the entrainment of gas within the broken material, and possibly the projected area over which the gaseous pressure involved acts. As an extreme example, no significant lift will be available from a vertical bore hole charge which only produces a few radial cracks, because of the minimal projected area over which the pressure acts, whilst a comparable charge which extensively fragments the formation will produce significant lift because of the greater area involved. Thus, lifting changes which have no free face should be inclined in order to spread gaseous pressure over a more significant projected area.

Figure 17:
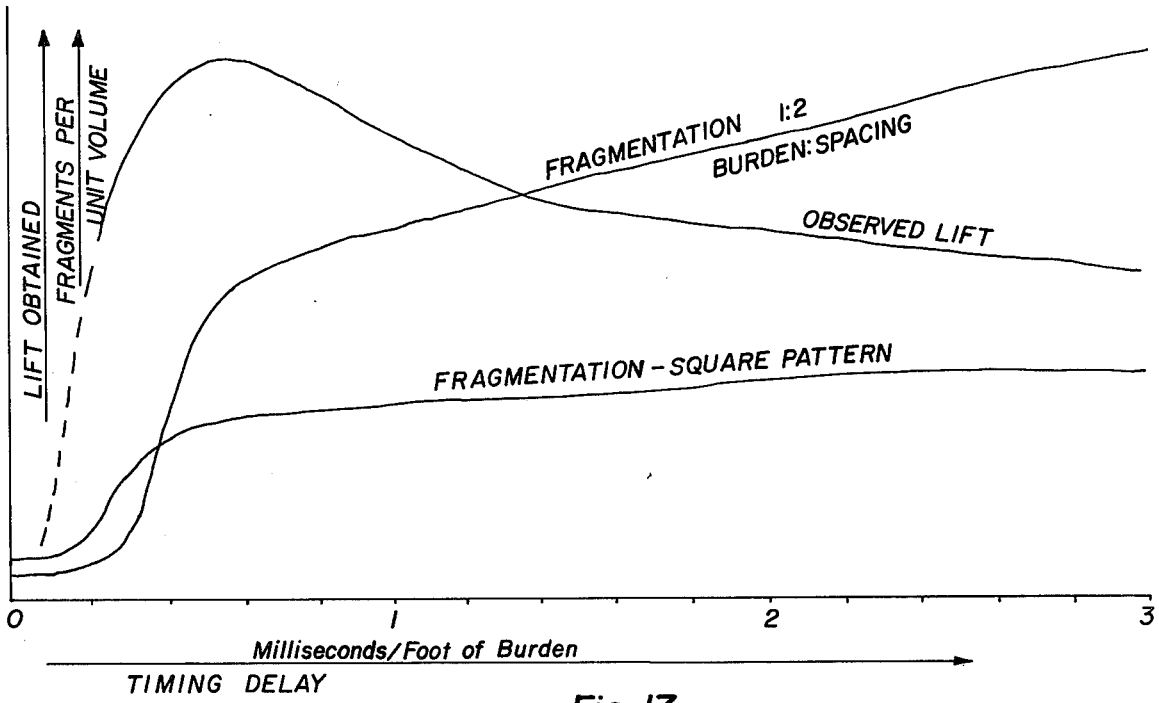
FIG. 17 is a chart showing fragmentation and observed lift in relation to various timing delays and patterns.

Equally important, and heretofore unrecognized, in the contrast between the poorly breaking charge and the efficiently fragmenting charge is the greatly extended time of action of the gas entrained in the finely fragmented rubble. Gas is able to vent rapidly from a few, comparatively wide cracks, but is retained, as in a sponge, when entrained in a myriad of fine crevices. Nevertheless, leakage does still occur, with some rapidity, so it is necessary that the timing of fragmenting charges 62–68 be a compromise between the demands for the lift required to raise the overburden and the demand for optimal fragmentation for subsequent retorting. The necessary timing is also complicated by the need to minimize flexure of the overburden 34, see FIG. 3, and the effects of blast patterns of differing effective burden:spacing ratios. These factors are illustrated in FIG. 17. Generally, we have found satisfactory the exploding of charges 62–68 at time intervals corresponding to about ⅓ to about 5 milliseconds per foot of effective burden; and that an optimum time interval is from about ⅓ to about 1.5 milliseconds per foot of effective burden. As a further feature of the present invention we have found a staggered pattern of blast holes to be preferred, see blast holes 51–56 in FIG. 5. Such patterns are also preferably drilled markedly oversquare, with the ratio of effective burden to effective spacing falling in the range of about 1 to 1.5 as a lower limit to about 1 to 4 as an upper limit.

The sequence adopted is also extremely important, as it controls the direction of movement of the rubble. Thus, adoption of a sequence which commences in the center of each row, the commonly used V pattern, will cause rubble to be moved toward the center line of the retort, concentrating lift likewise and so causing the highly undesirable doming, or even splitting, of the overburden layer and the equally objectionable development of open space at the sides of the retort, disruptive of the even permeability required for subsequent retorting. To avoid these disadvantages it is necessary to reverse normal blasting practice and commence the firing sequence near the ends of each row, i.e., proximate the periphery of the overburden to be lifted, so as to locally concentrate material movement to cause summation of vectors of movement of fragmented material and thus to preferentially concentrate lifting action proximate the periphery where the edge effects require the extra energy. This also causes the plugging of the open spaces which would be produced at this point by use of the V cut, and this may be further helped by use of a staggered pattern.

Figure 6:
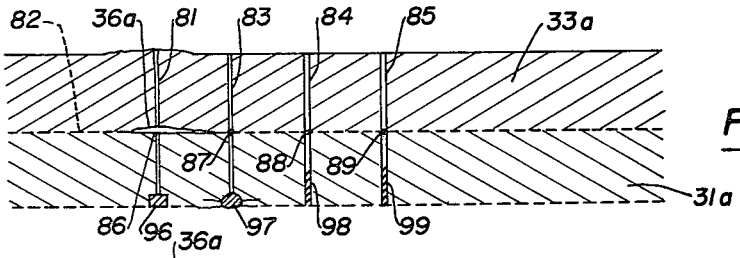
FIG. 6 is a vertical sectional view illustrating an arrangement of blast holes and charges for carrying out a second process of the present invention.
Figure 7:
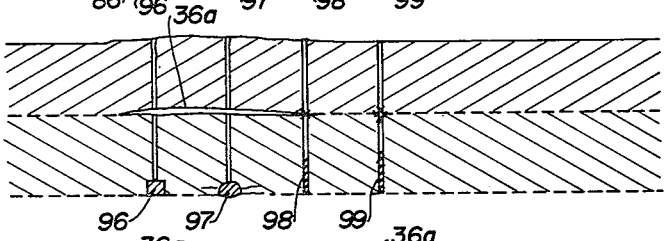
FIGS. 7–11 are vertical sectional views similar to FIG. 6, but showing further stages of the process.
Figure 8:
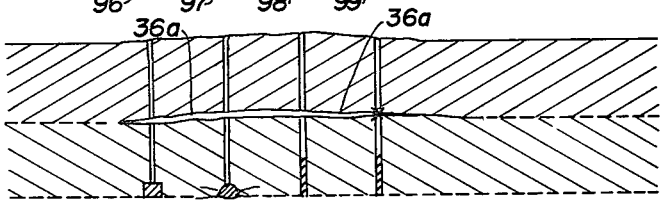

Lifting of the overburden may also be effected, as depicted in the embodiment of the invention illustrated in FIGS. 6–12, by drilling a bore hole 81 to intersect a selected plane of stratification 82, placing an explosive charge 86 in the bore hole proximate plane 82 and exploding the charge to cause separation of the strata substantially at the plane and the filling of the void created thereby with high pressure gas, in turn effecting a raising of a portion 34*a* of the overburden 33*a*. Preferably, in such case bore hole 81 is sealed above and below the charge to confine the gases substantially to the desired plane of stratification 82. Actually, a plurality of such bore holes are preferably drilled to intersect plane 82, see additional bore holes 83, 84 and 85, and explosive charges 87, 88 and 89 may be exploded substantially simultaneously with charge 86 in bore hole 81, or these charges may be exploded sequentially. In the latter case, charge 86 in blast hole 81 is first fired to initiate the separation (as depicted in FIG. 6) and propagation of a crack 36*a* along plane 82 with a leading edge of the crack advancing in the direction of charges 87–89; and the latter charges are preferably fired in timed relation to the propagation of the crack to effect a continuation thereof. Sensing of crack propagation may be effected by break-wire sensors 91 and 92, see FIG. 12, mounted across plane 82 and between charges 86 and 87, the sensors being here connected to a computer 93.

Figure 9:
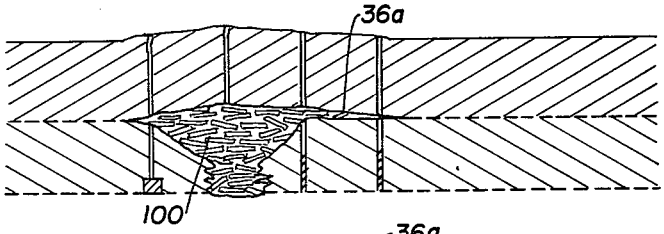
Figure 10:
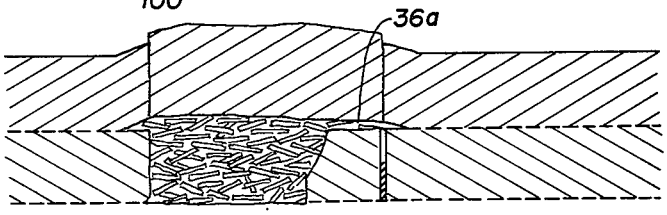
Figure 11:
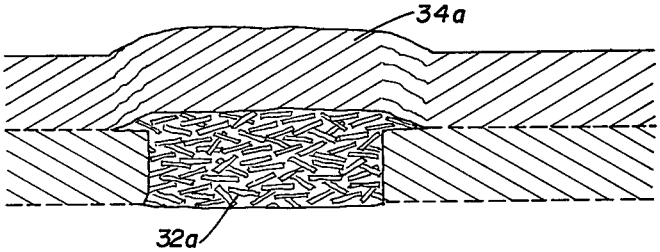

After a void space (crack 36*a*) has been opened up along plane 82, as hereinabove discussed, charges 96, 97, 98 and 99, positioned in the deposit below the void space, are exploded against the free face provided by the void space for fragmenting the deposit to distribute the void space, thus producing fractured, pervious, rubble-ized deposit in a defined enclosed retort 32*a*, see FIGS. 9–11. One of the medially located charges 97 may be fired first to produce a crater 100, as seen in FIG. 9. The adjacent charges 96 and 98 may then be fired against the free faces provided by the crater to enlarge the retort and to further raise the overburden. This process may be continued until the desired size retort 32*a* is developed under a riased overburden 34*a*, as seen in FIG. 11.

Figure 19:
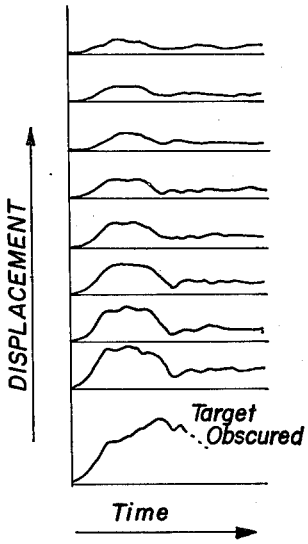
FIG. 19 is a time displacement chart for different photographic target positions.
Figure 18:
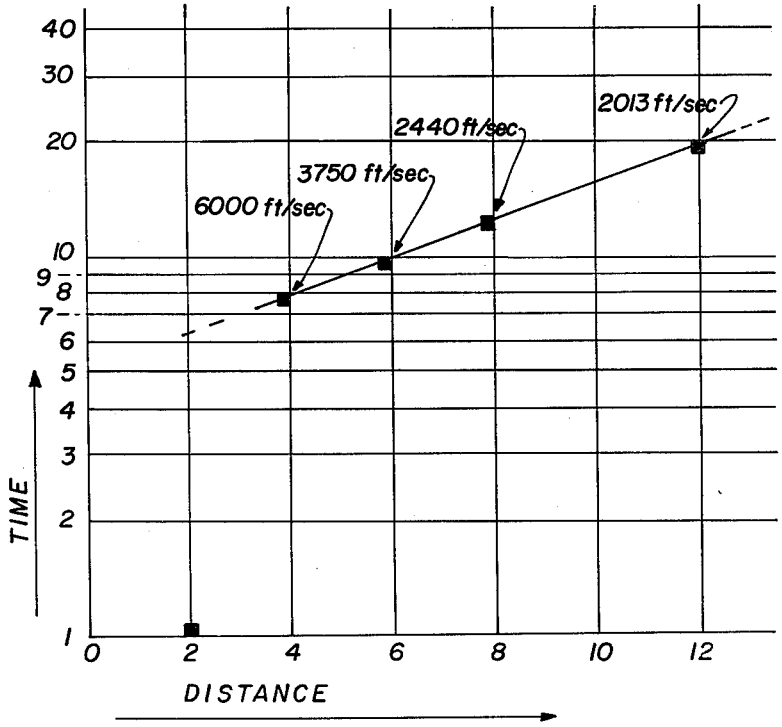
FIG. 18 is a time and distance chart showing speed of crack propagation.

A number of vibrational waves are known to travel through solid media. Important to this process are waves known as Rayleigh and Love waves. These waves exist because of the presence of an interface, the best known example being the sort of wave visible on the ocean and which is a Rayleigh wave. Love waves are particularly well known as waves from earthquakes which exist because of changing material properties beneath the surface of the earth. In the present instance, some of the waves are useful in that they cause tensile stress at an interface being split or at a point of fracture, or are helpful in that they tend at one portion of a cycle to cause upward motion of the overburden. The amplitude of these waves can be quite high, from several inches to as much as several feet, and they can be used advantageously if there is a reinforcing phased relationship between the explosives radiating energy and the waves. To detect the waves for a particular site, a simple procedure is available. One or more bore holes are drilled, charged and fired and the surface photographed by a high-speed camera. Photographic targets, as seen in FIG. 16, anchored to the surface, aid in determining exact motion. Simultaneous with this, the propagation of cracks underground can be tracked by use of a computer, as hereinabove noted. FIG. 18 shows the progression of a typical crack, specifically, the fracture tip. It does not show the width of the crack. FIG. 19 shows two basic modes of vibration within the overburden above the spreading crack, one a heavily damped sine wave having a frequency of about 3 cycles per second, and the other a sine wave having a frequency of about 25 waves per second. The actual velocity of these waves is not easily determinable from the graph, FIG. 19, but is easily determinable by measurement of arrival times of waves at both frequencies at a distance. For the purposes of the blasting, exact analysis of the mode of vibration may be unnecessary, since all one may need to know is that the overburden is rising at a particular time, to time the charges under the point where the overburden is rising, to aid in the propagation of the vibration. Thus, in the form of the invention depicted in FIG. 6, charges 87, 88 and 89 are sequentially exploded to reinforce the vibration assiting the separation and lifting of the overburden.

Figure 12:
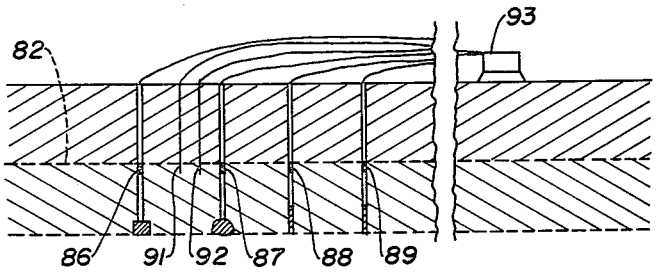
FIG. 12 is a diagrammatic vertical sectional view showing timing apparatus used in the control of the process depicted in FIGS. 6–11.

In developing the information shown in FIG. 18, break-wire sensors were placed, as illustrated in FIG. 12, 5 break-wire sensors being located at distances 2, 4, 6, 8 and 12 distance units from the shot point. In the absence of bore hole notching or other preparation, the propagation is indefinite and unpredictable in the immediate vicinity of the shot point, see initial point plotted on FIG. 18. However, once a crack has been firmly established, its propagation is then amenable to quite predictable laws, in this case showing propagation from a single shot point following a straightforward exponential velocity decay. The graphs, FIGS. 18 and 19, were produced from a shot which used only 12 ounces of low explosive. The technique as described makes it possible with moderate to small charges of explosives to push cracks in a predictable and controlled manner out to a large radius, thus making practical the concept of developing a gas-filled separation between strata in a controlled, predictable fashion for the purpose of lifting the overburden and providing a free face against which subsequent blasting for fragmenting can take place.

As hereinabove noted, charges 96–99 may be decked within bore holes 81, 83, 84 and 85, that is, separated from charges 86–89, by means of stemming material within the same bore hole. Decked charges may be fired simultaneously or they may be delayed relative to each other within a given bore hole. The significance of a decked charge is two-fold. One, it affects the amount and distribution of explosive which can be emplaced to fill the bore hole. Secondly, it enables the charges to behave independently, which may affect both the timing and geometrical behavior of the charges.

The geometric interaction of the charge shape and the local weakness introduced into the surrounding material by the presence of the bore hole greatly affects subsequent breakage, particularly in the immediate vicinity of the bore hole. If the bore hole is locally enlarged, this effect can be accentuated. Thus, a small diameter bore hole leading to an enlarged chamber may allow the charge to behave as a concentrated point charge rather than a distributed column charge. The effect of the charge will tend toward spherical behavior rather than cylindrical behavior in consequence. If an enlargement in a bore has been produced by the process known as "springing", this is to say, by the firing of one or more light charges within the bore hole to progressively enlarge the bore hole, there will be an important and hitherto unrecognized additional consequence in that the chamber produced will be surrounded by a fractured area consequential from the springing process. In a highly laminar material, such as oil shale, these fractures will extend significant distances, so not only will the charge behave as a concentrated charge because it is all placed in the chamber, but also gas will proceed out along the fractured planes which have been produced by the prior shooting more readily than they would were the explosive placed in a chamber produced by reaming. In consequence of this, a concentrated charge will tend to produce better sideways breakage from a sprung hole than from a reamed hole. In the embodiment shown in FIGS. 6–12, in the absence of chambering there is a strong tendency for the charge to break sideways because of cylindrical expansion from the bore hole rather than spherically, as it would from a chambered hole. The free face is in the wrong position initially for any sideways movement. Necessarily therefore, a bore hole charge would be inefficient for breaking towards the initial free face. A chambered charge, on the other hand, is highly efficient and, in accordance with the present invention, is preferably used in the case of at least certain of the fragmenting charges 96–99. When used in the case of the first charge fired, i.e., in the position of charge 97, there would tend to be produced a right cone of fragmented material in the form of a crater extending up from such charge to the free face provided by void 36*a*. A breakage of the subsequent charges 96, 98 and 99 would be critically dependent upon the depth of the cone. If the charge chamber has been produced by springing, as here shown for charge 97, there will be a tendency for gas to become entrained in horizontal cracks produced in the springing process, and it will therefore tend to break better to the bottom of the hole than would either a chambered hole or a plain bore hole of large enough diameter to contain the charge. This will produce breakage 100 as shown in FIG. 9, thus producing significantly enhanced bottom conditions for breakage of charges 96 and 98.

Figure 14:
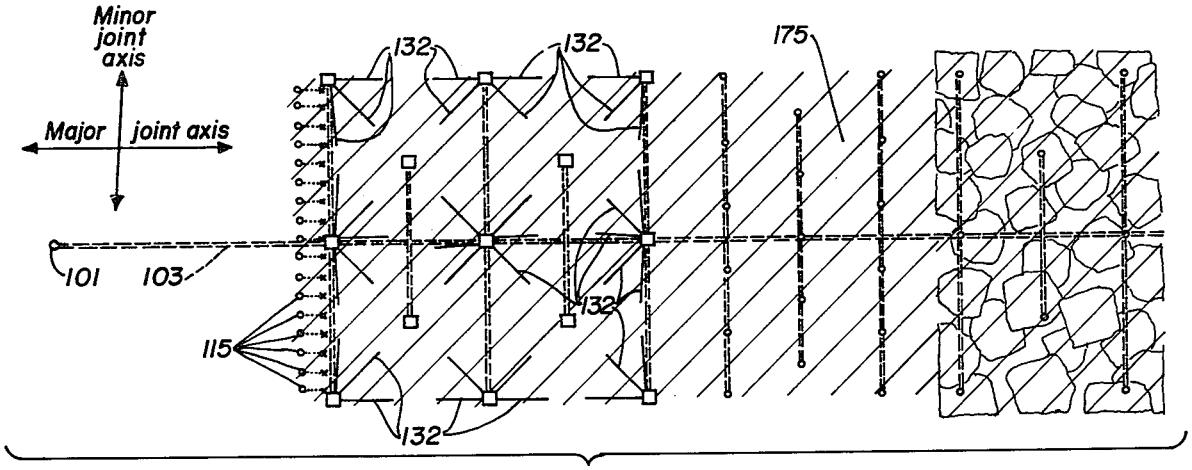
FIG. 14 is a plan sectional view taken substantially on the plane of line 14—14 of FIG. 13.
Figure 5:
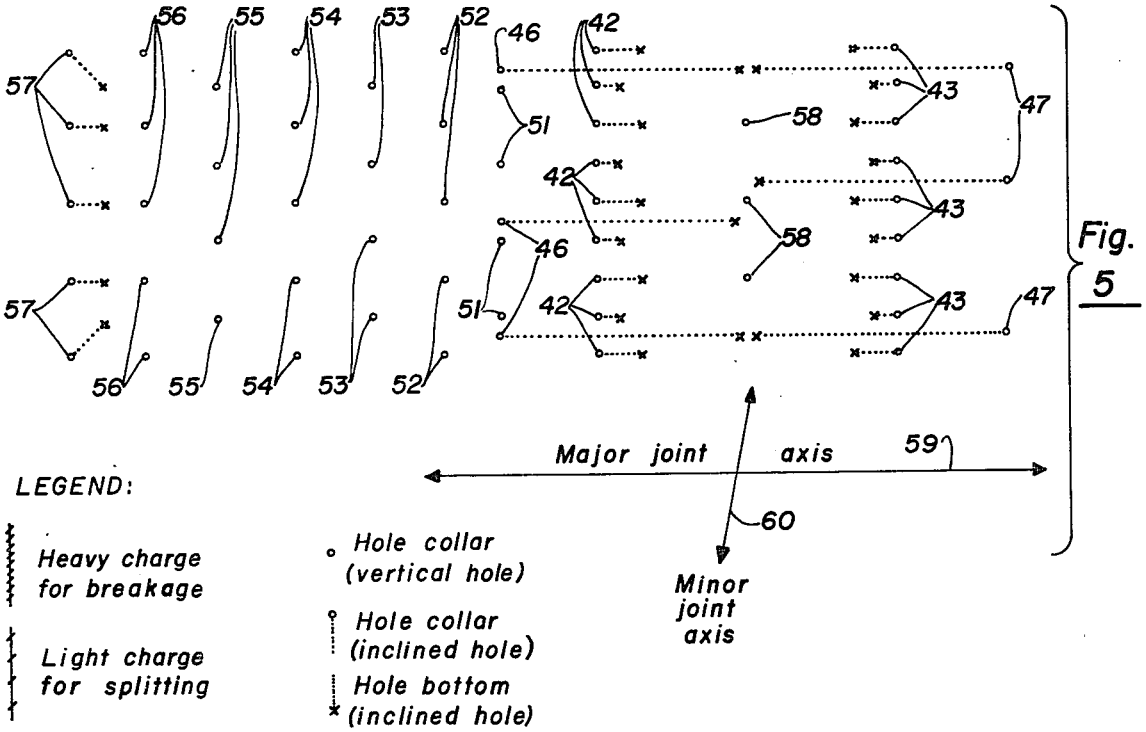
FIG. 5 is a plan view showing a preferred disposition of the blast holes in FIGS. 1–4.

A further form of the invention is illustrated in FIGS. 13 and 14 of the drawing, which may be referred to as a "mining approach", and it is the approach of preference where the overburden is too thick for operations to be easily and economically carried out from the surface. Obviously, any hole drilled from the surface into the overburden and thence into the ore deposit has a significant portion of its length in the overburden. If the only purpose of the hole is to place an explosive in the ore deposit, a large part of the drilling effort is wasted and expensive. Precision of drilling is also degraded with increasing distance. As the overburden increases in depth to around 100′ in thickness, a mining approach, avoiding the waste of drilling through the overburden and avoiding the loss of precision in drilling, becomes economically attractive. Of course, in such instances the high grade deposit must be sufficient to support the cost of the mining approach. As hereinabove noted, high grade oil shale can be found in many formations of great thickness. Representative geological situations may reasonably range from as little as about 100′ of overburden over 100′ of oil shale to 800′ of overburden over 1,200′ or more of oil shale. To carry out this form of the invention, mine shafts or passages are required to provide movement for men to go underground and into the oil shale deposit. Access can be provided by an adit, that is to say, a substantially horizontal passage opening to the surface, by an incline, or by a shaft, an essentially vertical passage, and the passages may be produced by any standard mining technique, including the use of a mechanical mole or large boring machine. With reference to FIG. 13, a vertical access shaft 101 leads from the surface 102 to a horizontal drift 103, from which are driven a series of crosscuts. A plurality of vertical passages 106, 107, 108, 109, 110, 111, 112 and 113 may be conveniently enlarged below a plane of stratification 82*a* by the well known process of raise boring.

The cost of the breakage is largely a function of the cost of emplacement of the charge. It may be unnecessary to distribute the explosive throughout the material, and if it is possible to avoid that, then emplacing the charge within a mined-out passage or an enlargement in a mined-out passage has substantial economic advantages. It also has advantages from the point of view of the chemistry of the explosive in that large amounts of material which would not ordinarily be explosive, or not violently so, can be used as an alternative to the comparatively expensive, sensitive, therefore somewhat hazardous, materials necessary for explosion in small bore holes. So obvious economic advantages come from the use of cheaper explosive and reduced cost of emplacing explosive. Further advantage may be obtained by virtue of the control which becomes available over reaction rates. There is comparatively little latitude in normal explosive to change the stress rates or the ultimate stresses in terms of pressure achieved. If large quantities of explosives are concentrated in a small area, then materials can be used which will enable a high degree of control over reaction rates, this later producing substantial improvements in the efficiency of the blasting and the type of breakage. It is unusual in even the massive blasts carried out during the mining of iron ore for any single hole to contain a charge weighing more than 2½ tons. Normal maximum charges for a single bore hole would be closer to 1 ton. In concentrating charges in the mine passages, we are producing charges substantially more massive than this. They may be anticipated to be typically from 5–30 tons of explosive per charge. Charges of this nature have been used in what are called "coyote blasts", a technique well known in the art. They are noted for their destructiveness and are generally used for producing very large quantities of rather coarsely broken material. Such material would appear on first sight to be unsuitable for retorting. However, the novel methods used in this embodiment allow the use of such charges for fragmentation of oil shale in a manner suitable for retorting.

As used herein, a "massive charge" is one exceeding 1 ton, and a "concentrated charge" is one where the radius of the charge extremities does not significantly extend beyond the radius of a spherical charge of the same mass. By "significantly" in this instance, we mean a factor of greater than 3.

The massive concentrated explosive charges and in this form of the invention may be conventional explosive or may comprise a carbonaceous fuel, such as coal, and a liquefied oxidant, such as liquid oxygen. This combination has a significant advantage environmentally over detonations where nitrogen is a component of the explosive, since it avoids the production of an consequent eventual venting to the atmosphere of oxides of nitrogen.

We gain also in safety potentially in that we are able to mix these components at a late stage in the process, so during the production and the placement of materials they can be held separate and, therefore, functionally inert until the last possible moment. This is of particular significance when it is realized that the stemming operation alone may involve many hundreds of tons of sand and some days or weeks of effort. The emplacement of the charges also will be a lengthy process. Safety is, therefore, greatly enhanced by the absence of any large concentrations of high explosive. We can, moreover, if we have liquid component, add the liquid through pipes as the final step at a time when all humans have been withdrawn from the retort and all stemming is complete. So a liquid oxidant, even if not liquefied oxygen, has significant advantages. Alternate liquids are hydrogen peroxide, which has a significant hazard in that it is unstable and is, therefore, unlikely to be used; concentrated nitric acid, which is much easier to make than ammonium nitrate; or liquefied oxides of nitrogen.

The combination of the carbonaceous fuel and liquid oxidant also has an important advantage in retaining the integrity of the overburden in the production of a slow shove rather than a violent detonation. This can be conveniently achieved by burning appropriately sized lumps of coal in an oxidant, the burning being rapid enough to behave explosively because of the laws of mass action.

Liquid oxygen-carbon mixtures have been known for many years, generally referred to as LOX. They have fallen from use because of repeated incidents involving death and injury where the materials exploded spontaneously. The unpredictable nature of these materials has effectively ruled out their use in blasting, which is considered generally unfortunate, as the explosive is a particularly fine explosive, very cheap, and requires minimum energy in its manufacture. The separation of the oxygen and the fuel and, particularly, an addition of oxygen to the fuel after men have been withdrawn from the retort represents a solution to the safety problem heretofore considered intractable. Previously, it has not been possible to entrain the oxygen in the explosive except by a soaking process, which produces a hazardous material. It is possible in this process in that the size of charge is large enough that a separate cryogenic containment becomes quite practical. The mixing step, in its simplest form, can be achieved by containing the liquid component in a containment vessel which can be ruptured upon command. The resulting flood of liquid from the containment vessel into the fuel performs the mix, and this mixture can then be either sequentially or simultaneously ignited by either special purpose igniters or by standard explosives or by the use of adjacent explosive charges.

The above techniques using liquified oxidant are also usable where sprung or chambered holes have adequate volume or where very large diameter holes or raised bores are available.

With reference to FIG. 13, it will be noted that enlargements 116, 117 and 118 are formed in passages 106, 108 and 110 at substantially the selected plane of stratification. Passages 106–113 afford manned access and, in the case of passages 106, 108 and 110, enable the placing of massive, concentrated explosive charges in enlargements 116–118. Exploding of these charges causes a separation of strata substantially on plane 82*a* to produce a void space and a free face and a filling of the space with high pressure gas initiating a raising of the overburden. Passages 106–110 are formed with enlargements or chambers in the ore deposit below the selected plane of stratification 82*a*, passage 106 containing chambers 121 and 122, passage 107 containing chamber 123 and 124, passage 108 containing chambers 125 and 126, passage 109 containing chambers 127 and 128, and passage 110 containing chambers 129 and 130. Massive, concentrated explosive charges are placed in each of the enlargements 121–130 and exploded to effect fragmentation of the deposit and to effect an additional raising of the overburden to provide a retort, as hereinabove described. Preferably, the charges in chambers 121–130 are sequentially fired, with charges in chambers 123 and 127 closest to the separation plane 82*a* being fired first for blasting against the free face created by such void space and thereafter the charges sequentially fired against the sequentially formed free faces.

To expedite the splitting effect, i.e., horizontal crack propagation at plane 82*a*, open bore holes 132 are drilled horizontally from enlargements 116, 117 and 118 substantially parallel to and proximate plane 82*a*, see FIG. 14, thereby producing a working effect to open the plane and to promote the gas-filled void space and separation, as well as to effect a notching of the edge of the chamber.

The foregoing effect can also be increased by placing explosive charges (not shown) in bore holes 132, and the gaseous movement resulting from the explosive charges in the bore holes 132 may be advantageously used to promote mixing of fuel and oxidant. Preferably in such case, the charges in bore holes 132 are not sealed from the massive, concentrated charges in chambers 116–118, and the charges are exploded from their outer extremities inwardly.

Alternatively, a similar effect may be achieved by placing explosive in bore holes 132, sealing same from the massive, concentrated charges in chamber 116–118, and exploding the charges sequentially, with the bore hole charges exploding in advance of the passage charges. The effect of this will differ from the above in that the plane of separation 82*a* will be initially filled with only a small quantity of high pressure gas, but which exerts a more even initial lifting pressure than would be obtained from the explosive within the chambers. Subsequent firing of the chamber charges will then spread gas along an already open plane. This minimizes stresses on the overburden, but requires that the chamber charges be fired before they are disturbed by entry of pressure from the bore hole charges. Computer monitoring of pressure sensors within the chambers and computer control of firing circuits may be utilized conveniently for this.

The preceding may also be combined with the production of a buffer zone, illustrated on FIGS. 22, 23 and discussed below.

In the process depicted in FIGS. 13 and 14, a novel method may be used to control primary breakage of the deposit, by drilling additional bore holes from one or more of the lower chambers 121–130. This arrangement is depicted in FIGS. 22 and 23. Emplacing and exploding charges in bore holes 134 will provide controlled initial fracture surfaces and so establish the primary breakage pattern of the charges placed in chambers 121*a*, 123*a*, and 127*a*. This is because the fractures introduced by the firing of the charges within bore holes 134 change the effective geometry of the material surrounding the main charges and also pre-establish and position the fracture tips which will subsequently propagate to the free face. As illustrated in FIGS. 22 and 23, this is being usefully employed to extend the horizontal breakage which would otherwise occur from chambers 123*a* and 127*a*, and to ensure that the vectors of movement of the primarily broken material are convergent rather than simply parallel and upward. This both improves the efficiency of breakage and also increases the volume broken. Contrastingly, the usage for chamber 121*a* is to decrease the volume broken, thereby reducing unwanted damage beyond the retort boundary. These techniques thus represent a significant advance in the ability of the explosive specialist to control blasting effects.

The rubble-ized zone 32*b* produced by the foregoing techniques is generally depicted at the right-hand side of FIG. 13 with its overlying raised overburden 34*b*. To ensure that the rubble zone is confined to a defined zone and to minimize gas leakage, rubble zones are preferably separated by substantial walls or pillars 175. These may be conveniently prepared for subsequent fragmentation by the installation of enlarged bore holes, illustrated as bore holes 111, 112, 113. It will be noted that a continuation of the drift 103, with attendant crosscuts, provides convenient access to the base of the rubble zone 32*b*; however, this does not imply any particular direction of subsequent retorting. The process of preparing the pillars 175 for subsequent retorting is reserved for a continuation application.

The imposition of severe stress waves on the overburden, as earlier herein discussed, is highly undesirable. One means of inhibiting this is to interpose between the charge forming the source of the wave and the overburden a barrier of shattered material. Arrangements for accomplishing this are illustrated in FIGS. 20 and 21 and in FIGS. 22 and 23.

Such a barrier has three desirable properties. One, it forms a substantial acoustic mismatch, effectively a free face, causing reflection, and secondly, by having but limited contact surface area with the boundaries across which a stress wave must pass, effectively limits the transmission of shock to the overburden. Thirdly, it is capable of absorbing peak stresses by crushing of the contained rubble.

Figure 20:
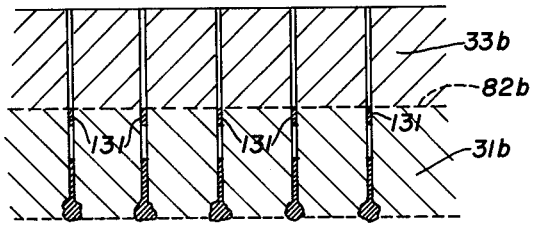
FIG. 20 is a vertical sectional view depicting another form of the invention.
Figure 21:
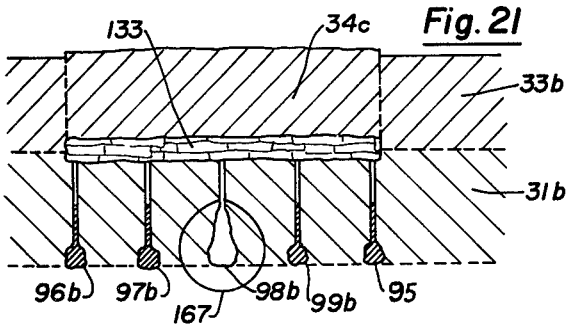
FIG. 21 is a view similar to FIG. 20, but showing an intermediate step in the process.

The arrangement depicted in FIGS. 20 and 21 is similar to that shown in FIG. 6, except that the upper charges 131 are located in the high grade ore 31*b* somewhat below the position of charges 86–89 in FIG. 6, preferably just below the desired plane 82*b*, and charges 131 are substantially heavier than charges 86–89 so that, when fired, charges 131 will produce a zone of shattered material 133, as seen in FIG. 21, between the high grade deposite 31*b* and the overburden 34*c*. The production of shattered zone 133 will be accompanied by an initial raising of a section 34*c* of the overburden overlying the horizontal shattered zone 133. After the formation of shattered zone 133, the lower deck charges 96*b*, 97*b*, 98*b*, 99*b* and 95 are fired to fragment the ore deposit, as above explained. Shock waves, depicted by wave 167, radiating from the explosion of charges 95, 96*b*–99*b* must now pass through the barrier provided by zone 133 of shattered material before reaching the rising block 34*c* of overburden. Thus, it is no longer necessary or desirable to initiate charges 95, 96*b*–99*b* from the top to reduce the intensity of the shocks traversing the overburden, and this energy may now be usefully employed improving fragmentation. While the rising section 34*c* of overburden is thus protected against the intense shock of explosion of charges 95, 96*b*–99*b*, the gases generated by such explosions are nevertheless entrapped in the sponge of fragmented material and released on a controlled basis for continuing the raising of the overburden to provide a fully developed retort chamber.

Disposition of the fragmenting charges in two or more decks provides additional advantages, since it allows the charges to be varied in position, magnitude, sequence and time of firing. This contributes importantly to this invention in two other ways. Firstly, the uppermost charges may be fired with a minimum relative timing delay, with respect to each other, resulting in minimum initial flexure of the overburden as upward velocity is initiated. The limiting factor and the minimum timing delagy is the necessity for producing acceptable fragmentation, see FIG. 17 and preceding discussion of factors affecting timing. Lower charges may then be fired at longer relative delays substantially exceeding the preferred minimum timing delays employed for the upper charges and also be delayed relative to the upper charges, since the presence of the buffer and the prior completion of the initial detaching of the overburden block from its surrounding parent material tends to inhibit subsequent severe flexure, resulting in improved fragmentation. Secondly, since the position of the charges may be varied vertically, either they may be clustered on selected planes to correspondingly concentrate permeability, or they may by arrayed in a pseudo-random disposition effecting an even permeability within the fragmented material, thus preventing development of a layered or otherwise channeled permeability. The specific choice will be determined by the particular geological formation and the specific retorting method to be subsequently used.

Figure 22:
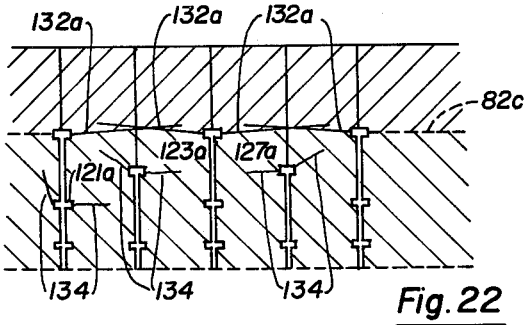
FIG. 22 is a vertical sectional view of a further form of the invention.
Figure 23:
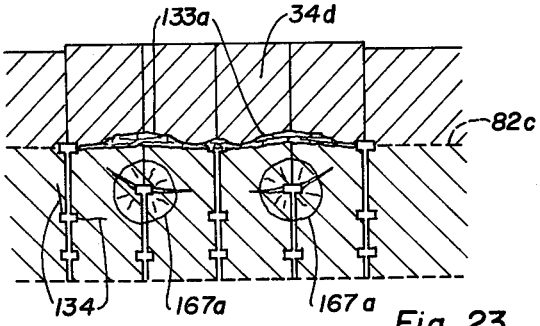
FIG. 23 is a vertical sectional view similar to FIG. 22, but showing an interim step in the process.

The arrangement depicted in FIGS. 22 and 23 is generally similar to that shown in FIGS. 13 and 14 with the exception that bore holes 132*a* along the plane of separation 82*c* are oriented to overlap so that, when explosives emplaced therein are exploded, the result will be the production of zones 133*a* of shattered material proximate plane 82*c* rather than the production of a clean plane of separation as in the embodiment described in connection with FIGS. 13 and 14. The firing of charges within blast holes 132*a* and the production of the zones 133*a* of shattered material will effect an initial raising of a section 34*d* of overburden, as depicted in FIG. 23. Thereafter, the firing of the lower chamber charges will effect a fragmenting of the deposit, as hereinabove described, and the shock waves 167*a* radiated from these charges will impinge upon the shattered zones which will thus soften the impact on the overburden. At the same time, the high pressure gases produced by the explosions of the lower chamber charges will uniformly act across the bottom of overburden section 34*d* to complete the raising thereof to provide the desired and required height of the retort chamber. The use of shattered zones 133*a* for protection of the integrity of the overburden is of particular importance in this form of the invention where very large explosive charges are emplaced and exploded in the ore deposit with attendant high intensity shock waves.

It is to be noted that, in the forms of the invention illustrated in FIGS. 20–23, the lifting of the overburden is performed simultaneously with the production of the shattered material, thus producing a free face against which subsequent fragmenting blasting charges will operate.

As hereinabove described, and as a feature of this invention, the techniques for production of the shattered material should be optimized to produce a fine degree of fragmentation to maximize the retention of gaseous pressure in the sponge work so produced in order that the steady lifting be prolonged for as long as possible. This may be accomplished by distributing the explosive in a large number of small diameter bore holes, increasing the specific charge, staggering the bore hole patterns, and using a large number of short firing delays. Similarly, where it is desired to maximize the lifting effect of fragmenting charges 62–68 and 96–99, similar methods are applicable. This is of particular advantage where unfavorable edge conditions require exceptional care to be taken for the production of adequate lift.

What is claimed is:

1. The process for converting subterranean rock into an enclosed rubble-ized zone overlain by an overburden comprising:

lifting a defined area of overburden as a substantially monolithic land mass to produce a void space and a free face proximate said rock, said raised overburden providing a substantially impervious closure for said space and said zone as provided herein;

placing an explosive charge in said rock proximate to and for blasting against said face; and exploding said charge for fragmenting and rock to distribute said space, thus producing fractured pervious rubble-ized rock in a defined enclosed zone.

2. The process of claim 1 comprising a two-step process for lifting said overburden comprising:

placing under said overburden and exploding an explosive charge, producing a gaseous pressure under said overburden to effect a first raising thereof providing said void space and free face; and producing a further gaseous pressure as a product of exploding said first-named charge to effect an additional raising of said overburden and enlargement of said space.

3. The process of claim 2, and locating said charges preferentially in harder strata of said deposit.

4. The process of claim 1, and defining planes of discontinuity peripherally about the overburden to be raised.

5. The process of claim 4, wherein said last-named step comprises detecting a plane of natural weakness and orienting said overburden to be raised in conformity thereto.

6. The process of claim 1, wherein said last-named step comprises producing a said plane of discontinuity by explosive fracturing.

7. The process of claim 6, said last-named step comprising:

drilling through said overburden a series of blast holes defining a side of the overburden to be raised;

placing explosive charges in said holes of a magnitude for effecting pre-splitting; and exploding said charges.

8. The process of claim 6, said last-named step comprising:

drilling through said overburden a series of blast holes defining a side of the overburden to be raised;

placing explosive charges in said holes of a magnitude for producing connected shattered zones; and exploding said charges.

9. The process of claim 6, said last-named step comprising:

drilling through said overburden a series of blast holes defining the overburden to be raised, said holes being drilled on an angle sloping inwardly to provide withdrawn wedge relief of friction as said overburden is raised;

placing explosive charges in said holes; and exploding said charges.

10. The process of claim 5, and detecting a plane sloping downwardly and inwardly with respect to the overburden to be raised, and orienting said overburden to be raised in conformity thereto to provide withdrawn wedge relief of friction as said overburden is raised.

11. The process of claim 1, said first-named step comprising:

drilling a series of blast holes arrayed substantially along a plane having a substantial horizontal component;

placing explosive charges in said holes; and exploding said charges to provide a gas-filled fracture underlying the overburden to be raised.

12. The process of claim 11, said first-named step comprising:

drilling said blast holes substantially along opposed downwardly converging planes so as to produce a raised wedge-shaped block.

13. The process of claim 12, and exploding said charges within a period of up to about one-third of the release time of said block.

14. The process of claim 12, and exploding said charges within a period of up to about 0.1 of the release time of said block.

15. The process of claim 12, wherein said fragmenting step comprises placing a charge in said deposit adjacent said blast holes positioned to effect said fragmenting and to augment said raising; and exploding said last-named charge at a time corresponding to the time required for said block to reach about $\frac{1}{2}$ to $\frac{3}{4}$ of the unaided rise height of said block.

16. The process of claim 11, said blast holes having a substantial vertical component; and initiating the exploding of said charges from the top of each charge to effect propagation of the explosion in a downward direction.

17. The process of claim 2, wherein said first-named gaseous pressure is produced by a low explosive.

18. The process of claim 1, placing additional charges in said rock proximate to said face and in horizontallly spaced relation to each other; and sequentially exploding said last-named charges to successively horizontally enlarge said void space and the quantity of fragmented material and to progressively enlarge the area of raised overburden.

19. The process of claim 18, and exploding said last-named charges at time intervals corresponding to $\frac{1}{3}$ to 5 milliseconds per foot of effective burden.

20. The process of claim 18, and exploding said last-named charges at time intervals corresponding to $\frac{1}{3}$ to 1.5 milliseconds per foot of effective burden.

21. The process of claim 18, and positioning said last-named charges in a staggered pattern.

22. The process of claim 18, and positioning said last-named charges with a ratio of effective burden to effective spacing in the range of about 1 to 1.5, to about 1 to 4.

23. The process of claim 18, and sequencing the exploding of said last-named charges such that at least some of the charges proximate the periphery of the overburden to be raised are exploded in advance of adjacent charges to cause the summation of vectors of movement of fragmented material to preferentially concentrate lifting action proximate said periphery.

24. The process of claim 18, and disposing at least certain of said additional charges in vertically spaced relation and clustering the vertical distribution of said additional charges to effect locally concentrated permeability within the fragmented material.

25. The process of claim 18, and disposing at least certain of said additional charges in vertically spaced relation and in pseudo-random vertical distribution to effect an even permeability within the fragmented material.

26. The process of claim 18, and disposing at least certain of said additional charges in vertically spaced relation and exploding the uppermost charges with the minimum relative timing delays, with respect to each other, which will effect an acceptable degree of fragmentation, thereby minimizing flexure of the overburden.

27. The process of claim 18, and disposing at least certain of said additional charges in vertically separated relation; and delaying the firing of the lower charges relative to the upper charges.

28. The process of claim 18, and disposing at least certain of said additional charges in vertically separated relation; and sequentially firing the lower of said additional charges with timing delays substantially exceeding the timing delays employed for firing the upper of said additional charges.

29. The process of claim 1 wherein, said steps comprise the drilling from the surface through said overburden and into said deposit of a series of blast holes arrayed substantially along a plane having a substantial horizontal component;

placing explosive charges in said holes;

exploding said charges to provide a gas-filled fracture underlying the burden to be raised and providing at least one free face in said deposit;

drilling additional blast holes from the surface through said overburden into said deposit in horizontally spaced relation to said face and in horizontally spaced relation to each other;

placing explosive charges in said additional blast holes; and sequentially exploding said last-named charges to successively horizontally enlarge said void space and to progressively enlarge the raised overburden.

30. The process of claim 18, drilling blast holes for emplacement of said additional charges, said last-named blast holes being drilled at progressive depths to provide a sloping floor for said enlarged void space.

31. The process of claim 1, said first-named step comprising:

drilling a bore hole to intersect a selected plane;

placing an explosive charge in said bore hole proximate said plane; and exploding said charge to cause a separation substantially at said plane and filling the void created thereby with high pressure gas.

32. The process of claim 31, and sealing said bore hole to confine said gases substantially to said plane.

33. The process of claim 31, drilling a plurality of said bore holes and placing a plurality of explosive charges in said bore holes proximate said plane; and exploding said charges substantially simultaneously.

34. The process of claim 31, drilling a plurality of said bore holes and placing a plurality of explosive charges therein proximate said plane;

exploding a first of said charges to initiate said separation and propagation thereof with the leading edge advancing in the direction of a second of said charges; and exploding said second charge in timed relation to said propagation to effect a continuation thereof.

35. The process of claim 34, drilling additional bore holes positioned generally in alignment with the direction of said propagation and placing explosive charges in said last-named bore holes proximate said plane; and sequentially exploding said last-named charges in timed relation to said propagation to effect a continuation thereof.

36. The process of claim 35, detecting a vibration assisting the separation and lifting of the overburden; and exploding said charges at such intervals as to reinforce said vibration.

37. The process of claim 31, wherein said void provides at least one free face;

placing an explosive charge in said rock adjacent said face; and exploding said last-named charge to effect said fragmenting.

38. The process of claim 37 wherein said last-named charge is placed as a deck charge in said bore hole.

39. The process of claim 37 wherein said last-named charge is placed within an enlarged chamber in a bore hole.

40. The process of claim 37, springing a bore hole to effect an enlargement therein in said deposit; and placing said last-named charge in said enlargement.

41. The process of claim 37, sequencing the firing of said charges with the exploding of said last-named charge subsequent to said first-named charge.

42. The process of claim 37, placing additional charges in said deposit in vertically spaced relation to said face and in horizontally spaced relation to each other; and sequentially exploding said additional charges to progressively enlarge the body of fractured pervious oil shale.

43. The process of claim 2 comprising:

providing a plurality of mine passages affording manned access to said rock extending substantially to a selected plane;

placing massive concentrated explosive charges in said passages proximate said plane;

exploding said charges to cause separation of strata substantially at said plane to produce a void space and a free face and filling said space with high pressure gas effecting said first raising of said overburden;

placing additional massive concentrated explosive charges in said rock below and spaced for blasting against said face; and exploding said additional charges for fragmenting said rock to distribute said space and effecting said additional raising of said overburden.

44. The process of claim 2, at least one of said charges comprising carbonaceous fuel and a liquefied oxidant, said fuel and oxidant being separately placed and mixed in situ.

45. The process of claim 44, said oxidant comprising liquid oxygen.

46. The process of claim 44, wherein said oxidant comprises concentrated nitric acid.

47. The process of claim 44, wherein said oxidant comprises an oxide of nitrogen.

48. The process of claim 43, drilling a plurality of bore holes from at least one of said passages substantially parallel to and proximate said plane and functioning to promote said gas-filled void space and separation.

49. The process of claim 48, placing explosive charges in said bore holes; and exploding said last-named charges.

50. The process of claim 44, drilling a plurality of bore holes from at least one of said passages substantially parallel to and proximate said plane;

placing explosive charges in said bore holes; and initiating the explosion of said last-named charges at the ends of said bore holes remote from said passage, thereby promoting the mixing and exploding of said fuel and oxidant.

51. The process of claim 49, sealing the charges in said passage from the charges in said bore holes; and exploding said charges sequentially with said bore hole charges exploding in advance of said passage charge.

52. The process of claim 43, controlling primary breakage of said rock comprising:

drilling bore holes into said rock adjacent at least one of said massive charges;

placing explosive charges in said bore holes; and exploding said last-named charges to provide an initial fracture surface proximate said last-named massive charge.

53. The process of claim 2, and producing a zone of shattered material between said overburden and said first-named charge prior to exploding said first-named charge.

54. The process of claim 2, and selecting for said first-named charge a combination of specific charge, charge distribution and short-delay timing to effect production of a zone of finely fragmented material functioning to momentarily entrain gaseous explosion products.

55. The process of claim 2, and selecting for said last-named charge a combination of specific charge, charge distribution and short-delay timing to effect production of a zone of finely fragmented material functioning to momentarily entrain gaseous explosion products.

* * * * *